US005781509A

United States Patent [19]

Zehner

[11] Patent Number: 5,781,509

[45] Date of Patent: Jul. 14, 1998

[54] WIDE BEAM ARRAY WITH SHARP CUTOFF

[75] Inventor: William J. Zehner, Lynn Haven, Fla.

[73] Assignee: The United States of America as represented by the Secretary of the Navy, Washington, D.C.

[21] Appl. No.: 668,456

[22] Filed: May 28, 1996

[51] Int. Cl.[6] ..... H04R 17/00

[52] U.S. Cl. ..... 367/159; 367/151; 367/153; 367/155; 310/334; 310/335; 310/371

[58] Field of Search ..... 310/371, 335, 310/334; 367/153, 159, 141, 150, 152, 151, 154, 155

[56] References Cited

U.S. PATENT DOCUMENTS

| | | | |
|---|---|---|---|
| 4,101,795 | 7/1978 | Fukumoto et al. | 310/336 |
| 4,413,331 | 11/1983 | Rowe, Jr. et al. | 367/151 |
| 4,998,549 | 3/1991 | Bran | 310/340 |

*Primary Examiner*—Ian J. Lobo
*Attorney, Agent, or Firm*—Harvey A. Gilbert

[57] ABSTRACT

A transducer array is constructed from a constant arc length portion of a right circular cylindrical shell of piezoelectric transduction material. The constant arc length portion is segmented evenly along the length thereof to define a plurality of transducers. The transducers can be in the free field or mounted on a planar baffle.

8 Claims, 2 Drawing Sheets

WIDE BEAM ARRAY WITH SHARP CUTOFF

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to transducer arrays, and more particularly to a transducer array capable of producing a wide beam over the desired field of view while reducing or eliminating energy radiated in directions other than the desired field of view.

BACKGROUND OF THE INVENTION

In echo ranging sonar systems of both the side-scanning variety and sector-scanning variety, an acoustic pulse is generally transmitted in a broad vertical pattern (approximately 90°) on each side of a sonar vehicle. The acoustic pulse is also depressed nominally 45° below the horizon in order to irradiate the bottom from directly under the vehicle out to the desired maximum horizontal range. Since side-scanning and sector-scanning systems are often used in shallow water, it is desirable to produce a beam with very low radiation above the horizon so that acoustic reverberation from the water surface does not interfere with reception of signals echoed from the bottom and by targets located in the water column below the vehicle. The ideal beam would have no side lobes and infinitely sharp roll off at the edge of the main lobe as indicated by the pressure amplitude response curve 20 shown in FIG. 1. In practice, however, such a beam is not realizable. For example, the commonly used simple line array produces a sin(x)/x response curve 22. For moderately small beams (i.e., 25° or less), various amplitude shading functions can be used to reduce side lobe levels at the expense of broadened main lobe width and slower roll off. For larger beam widths, however, such shading is not effective.

In the horizontal plane, the ideal radiation pattern is a very narrow rectangle of width approximately equal to the distance traveled by the vehicle between transmissions. One prior art approach attempts to achieve a very wide aperture in the direction of travel which results in an extreme near field rectangular pattern. Another approach strives to achieve a short aperture so that a far field sin(x)/x pattern is produced. The former approach tends to have undesirable ripple in the main lobe of the pattern. The latter approach uses transducers having a small surface area. Using small surface area transducers limits the amount of power that can be transmitted due either to mechanical stress levels in the typically ceramic transducers or to the onset of cavitation near the transducers.

The array structures used in these approaches generally fall into two types. One type is constructed from planar transducer elements mounted side-by-side on a baffle along the direction of travel. However, the radiating area is generally small with a great deal of radiation occurring outside the region of interest. Another array structure uses flat stave transducer elements mounted on a cylinder. Such a design is complex in construction and does not offer an ideal response with respect to side lobe roll off.

SUMMARY OF THE INVENTION

Accordingly, it is an object of the present invention to provide a transducer array structure for generating acoustic energy throughout a desired field of view.

Another object of the present invention is to provide a transducer array structure that reduces or eliminates acoustic energy radiated in directions other than the desired field of view.

Still another object of the present invention is to provide a transducer array structure capable of achieving a very rapid transition from the desired field of view to the cutoff region.

Yet another object of the present invention is to provide a transducer array structure in which the transducer surface area can be sufficiently large enough so that stress levels developed in the transducer material are below fatigue limits.

A further object of the present invention is to provide a transducer array structure that is simple in construction.

Other objects and advantages of the present invention will become more obvious hereinafter in the specification and drawings.

In accordance with the present invention, a transducer array is constructed from a constant arc length portion of a right circular cylindrical shell of piezoelectric transduction material. The constant arc length portion is segmented evenly along the length thereof to define a plurality of transducers. The transducers can be in the free field or mounted on a planar baffle such that the convex curvature of the constant arc length portion faces away from the planar baffle.

DETAILED DESCRIPTION OF THE INVENTION

Figure 1:
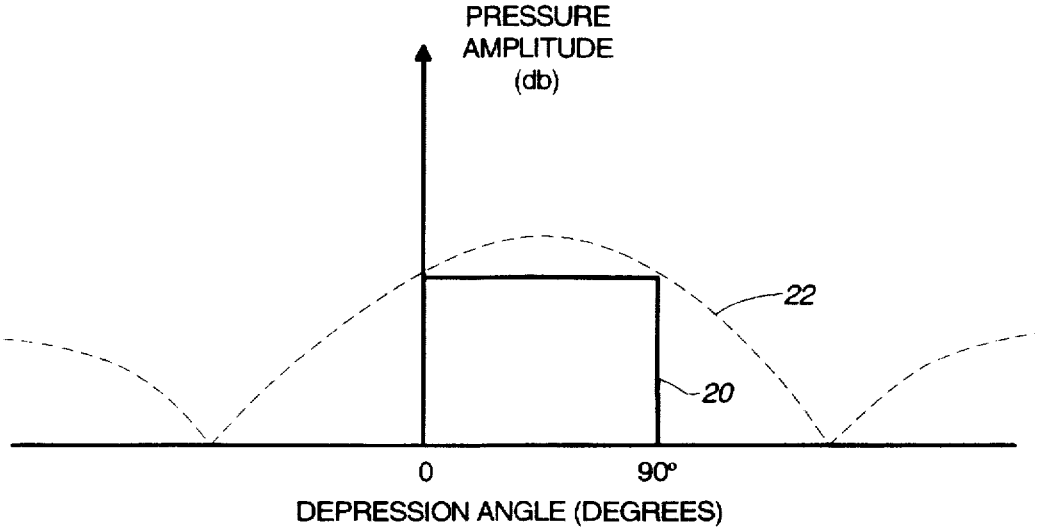
FIG. 1 is a graph of pressure amplitude versus depression angle for both an ideal beam and the beam typically produced by a line array.
Figure 2:
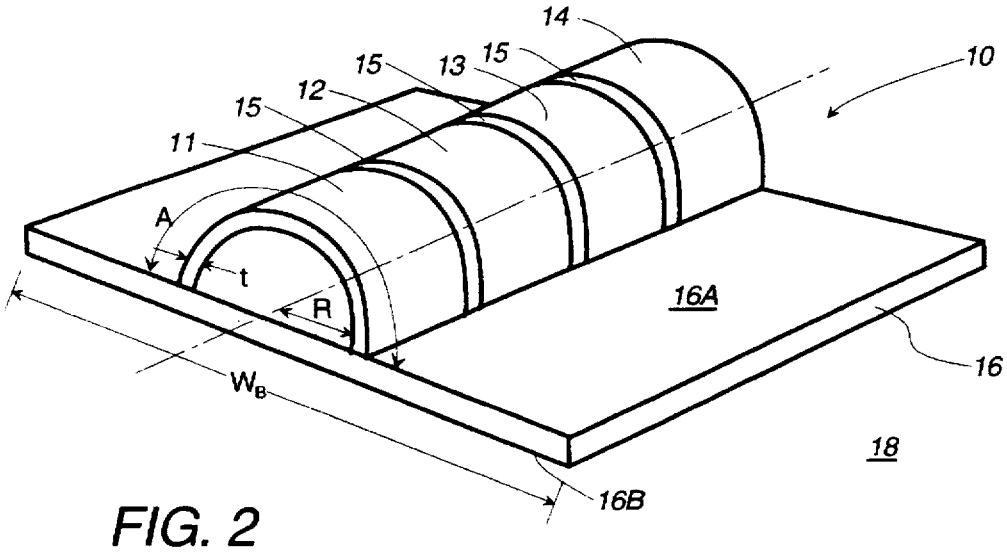
FIG. 2 is a perspective view of the transducer array according to the present invention.

Referring now to the drawings, and more particularly to FIG. 2, a perspective view of one embodiment of the transducer array according to the present invention as shown and referenced generally by numeral 10. Transducer array 10 has a plurality of transducers (four are shown in FIG. 2) 11, 12, 13, 14 arranged side-by-side and mounted on planar face 16A of baffle 16. Each of transducers 11, 12, 13, 14 is formed from an arc, e.g., semicircular, of a right circular cylindrical shell of thickness t of a piezoelectric transduction material. Each transducer is separated from the other by a small amount of acoustic isolation material 15 of low acoustic impedance as is known in the art of transducer array construction. The thickness t is determined by the desired operating frequency as is known in the art. Each transducer would typically have the same radius R and arc length A and share a common central axis 17 that is the major axis of array 10. The choice of piezoelectric transduction material is not critical to the present invention as long as the material can be formed as a continuous arc of a cylindrical shell as described herein. Each cylindrical transducer shell can also be constructed as a mosaic of small rectangular piezoelectric tiles.

Baffle 16 is a planar baffle constructed from either a sound absorbing or sound reflecting material. Perfect sound absorbers can be approximated by composites such as soft rubber loaded with metallic particles such as aluminum. One such sound absorbing material is available from B. F. Goodrich Co. under the tradename SOAB. The thickness of the acoustic absorber is determined by the desired operating frequency and characteristics of the absorber material. Perfect acoustic reflectors can be approximated by several methods. For example, baffle 16 could be a quarter-wave thick plate of high acoustic impedance material such as steel, aluminum, brass, lead titanium, gold, silver, or other high acoustic impedance metal or composite. Planar face 16B, which is opposite planar face 16A, is placed in contact with a low acoustic impedance material or environment 18. Such materials include foam, cloth, wood, etc, while such environments include a vacuum, air or water. The width of baffle 16 perpendicular to axis 17, denoted as $W_B$ in FIG. 2, must be wider than the area covered by the transducers. In general, $W_B$ should be at least three or four times the radius of the transducer shell.

Figure 3:
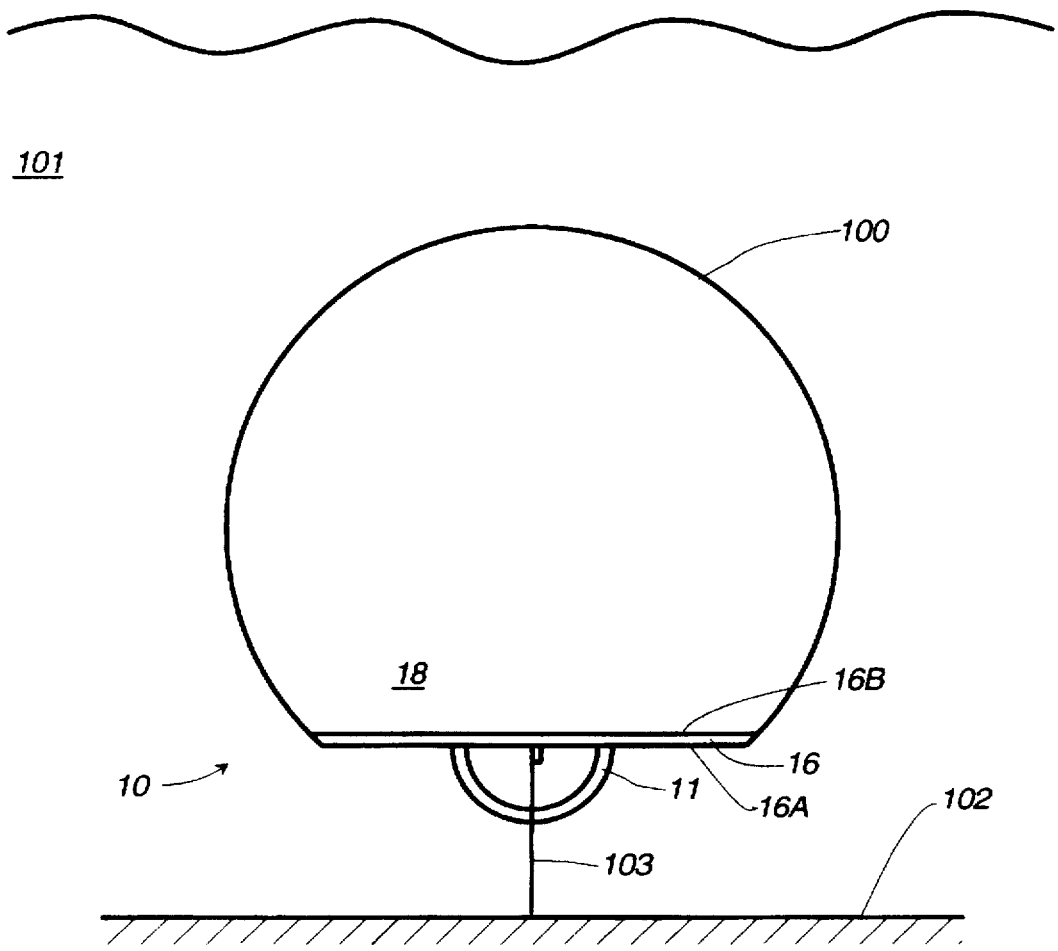
FIG. 3 is a sonar vehicle cross-section with the preferred embodiment transducer array mounted underneath.

By way of illustration, it will be assumed that the transducer array of the present invention is mounted underneath a sonar vehicle or watercraft with the transducers' axis 17 aligned along the direction of travel and planar face 16A facing substantially downward. This configuration is shown in FIG. 3 where transducer array 10 is shown mounted underneath vehicle 100 which is assumed to be traveling in seawater 101 above sea floor 102. Direction of travel is into or out of the paper.

In terms of radiating acoustic energy below vehicle 100 in a pattern that is uniform at ±90° from vertical, i.e., vertical line 103 normal to planar baffle 16, each of the transducers is formed from a semicircular arc of a right circular cylindrical shell of an appropriate piezoelectric transduction material. If baffle 16 and environment 18 are selected to form an acoustic reflector, the semicircular transducers look like a full cylinder rather than a half cylinder. This produces a radiation pattern that is the same as a full cylinder with low ripple in the pass band. However, baffle 16 causes the response to be very sharply cut off at ±90°.

The advantages of this preferred embodiment are numerous. The entire field of view underneath a vehicle can be illuminated while virtually eliminating radiation up to the sea surface. Furthermore, the transition between the desired and undesired field of views is very sharply defined. Each transducer presents a large surface area so that fatigue in the transducer material is not a problem even for higher operating power levels. The transducers can be easily wired to produce the well-known bizonal shading function for the suppression of side lobes in any plane containing the major axis of the array. However, this is not necessary for the correct formation of the desired sharp beam cutoff in the plane normal to the major axis of the transducer array of the present invention.

Although the invention has been described relative to a specific embodiment thereof, there are numerous variations and modifications that will be readily apparent to those skilled in the art in light of the above teachings. For example, each transducer could have an arc ranging up to the semicircular arc described above. However, in order to minimize the chances of stress related fatigue in each transducer element, the arc would typically range between a quarter circle and a semicircle. In addition, while the radius of curvature of each transducer element is not critical to the present invention, the larger the radius (in terms of wavelengths), the lower the ripple with the lower practical limit on radius of 5 to 10 wavelengths. Also, the wider the baffle (in wavelengths), the sharper the roll off. Still further, the present invention could be practiced without the use of any baffle, i.e., the transducers would just be placed in the free field. However, this will result in some acoustic radiation in the skirts of the response which may fall outside the desired field of view. It is therefore to be understood that, within the scope of the appended claims, the invention may be practiced other than as specifically described.

What is claimed as new and desired to be secured by Letters Patent of the United States is:

1. A transducer array comprising:

a planar baffle of a construction that prevents the passage of acoustic energy therethrough; and a constant semicircular arc length portion of a right circular cylindrical shell of piezoelectric transduction material mounted on said planar baffle such that the convex curvature of said constant arc length portion faces away from said planar baffle, said right circular cylindrical shell having a radius and a central axis, wherein the width of said planar baffle perpendicular to said central axis is at least three times said radius of said right circular cylindrical shell, said constant semicircular arc length portion being segmented evenly along the length thereof to define a plurality of transducers, wherein acoustic radiation produced by said plurality of transducers is prevented from radiating around said planar baffle.

2. A transducer array as in claim 1 wherein said planar baffle is constructed from a sound absorbing material.

3. A transducer array as in claim 1 wherein said planar baffle is constructed from a sound reflecting material.

4. A transducer array as in claim 1 wherein said planar baffle comprises a plate of high acoustic impedance material having a first planar face on which said plurality of transducers are mounted and having a second planar face opposite said first planar face, said high acoustic impedance material selected from the group consisting of steel, aluminum, brass, lead titanium, gold and silver, wherein a low acoustic impedance environment is in contact with said second planar face, said low acoustic impedance environment selected from the group consisting of foam, cloth, wood, air, a vacuum and water.

5. A transducer array as in claim 4 wherein said plate is a quarter wavelength thick.

6. A transducer array for a watercraft, comprising:

an acoustically reflective planar baffle mounted to the underside of the watercraft and beneath the surface of water, said acoustically reflective planar baffle having a first planar side facing substantially downward from the watercraft;

a semicircular portion of a right circular cylindrical shell of piezoelectric transduction material having a radius and a central axis, said semicircular portion mounted on said first planar side such that the convex curvature of said semicircular portion faces away from said first planar side, said semicircular portion being segmented evenly along the length thereof to define a plurality of transducers; and said acoustically reflective planar baffle having a width measured perpendicular to said central axis that is at least three times said radius of said right circular cylindrical shell, wherein acoustic radiation produced by said plurality of transducers is prevented from radiating to the surface of the water.

7. A transducer array as in claim 6 wherein said acoustically reflective planar baffle comprises a quarter wave thick plate of high acoustic impedance material selected from the group consisting of steel, aluminum, brass, lead titanium, gold and silver.

8. A transducer array as in claim 7 wherein said plate has a backing side opposite said first planar side, said backing side in contact with a low acoustic impedance environment selected from the group consisting of foam, cloth, wood, air, a vacuum and water.

* * * * *